United States Patent [19]

Calvert et al.

[11] 4,012,887

[45] Mar. 22, 1977

[54] PACKAGING MACHINE

[75] Inventors: Rodney K. Calvert, Dunwoody; Dale K. Scott, Jonesboro, both of Ga.

[73] Assignee: The Mead Corporation, Dayton, Ohio

[22] Filed: Jan. 19, 1976

[21] Appl. No.: 650,175

[52] U.S. Cl. ..... 53/48; 53/186; 53/251

[51] Int. Cl.[2] ..... B65B 5/10; B65B 43/24

[58] Field of Search ..... 53/48, 186, 252, 284, 53/374, 383, 251

[56] References Cited

UNITED STATES PATENTS

| | | | |
|---|---|---|---|
| 2,756,553 | 7/1956 | Ferguson et al. | 53/48 X |
| 3,039,248 | 6/1962 | Jones | 53/186 X |
| 3,058,271 | 10/1962 | McGihon | 53/48 X |
| 3,300,947 | 1/1967 | Fahrenbach | 53/186 |
| 3,645,068 | 2/1972 | Langen | 53/186 |

*Primary Examiner*—Robert Louis Spruill

*Attorney, Agent, or Firm*—Walter M. Rodgers; Walter A. Rodgers

[57] ABSTRACT

A machine withdraws collapsed sleeve type containers in sequence from a hopper and sets up each collapsed blank into a condition for receiving bottles through the open ends thereof and includes an oscillatable loading arm disposed adjacent an open end of the set-up sleeve for engaging articles and for moving those articles into the open end of the sleeve together with movable end flap folding means for engaging end flaps disposed on one end edge of a trailing side wall together with a fixed plow which engages end flaps foldably joined to an end edge of a leading side wall to manipulate those flaps into closed condition following loading, and fixed top and bottom end flap folding plows engage the top and bottom end flaps in sequence to fold those flaps into closed condition following operation of glue applying means which applies glue to the outer surface of the upper end flap immediately prior to engagement of that surface by the inner surface of the lower end flap.

9 Claims, 4 Drawing Figures

PACKAGING MACHINE

U.S. Pat. No. 3,904,036 issued Sept. 9, 1975, discloses and claims a sleeve type container which when fully set up, loaded and closed forms a complete enclosure for the container contents such as a plurality of bottles having tapered necks.

U.S. patent application Ser. No. 632,226 filed Nov. 17, 1975, discloses and claims a partitioning insert which is specially adapted for separating articles such as bottles which are packaged within the enclosed container of U.S. Pat. No. 3,904,036.

U.S. patent application Ser. No. 650,805 filed Jan. 20, 1976 discloses and claims apparatus which is specially adapted for use in setting up and in applying the insert of the aforementioned application Ser. No. 632,226 to groups of articles such as bottles prior to the loading of such groups through the open ends of the container of U.S. Pat. No. 3,904,036.

U.S. patent application Ser. No. 642,658 filed Dec. 19, 1975, now U.S. Pat. No. 3,990,572 discloses and claims an arrangement which is especially well suited for use in feeding groups of bottles from a station at which inserts are applied to the bottles according to application Ser. No. 650,805 and for moving the groups of articles and their inserts inwardly toward an open end of a sleeve type container disposed transversely with respect to the paths of movement of the containers and of the bottles to be loaded therein.

This invention is primarily concerned with setting up the container such as that disclosed and claimed in U.S. Pat. No. 3,904,036 into an open ended condition and for thereafter loading groups of articles through the open ends of the container and for subsequently closing the container end flaps to complete the wrapper. More specifically this invention includes means for withdrawing collapsed open ended sleeve type containers in sequence from a hopper and for setting up the containers into open ended condition paths for loading together with oscillatable means having a component of movement transverse to the direction of movement of the containers and of the articles to be loaded therein and also characterized by a component of movement which is the direction of movement of the containers and articles and which is arranged so as to engage and move the articles into the open ended container, and means for closing and securing in closed condition end flaps foldably joined to the end edges of the top, bottom and side walls of the container so as to form a completely enclosed and fully partitioned structure for the primary packages such as glass bottles.

For a better understanding of the invention reference may be had to the following detailed description taken in conjunction with the accompanying drawings in which FIG. 1 is a perspective view of a sleeve type container shown with its end flaps in open or article loading condition;

FIG. 3 is a side view of the outfeed end of the machine formed according to this invention and which constitutes a continuation of the right hand end of FIG. 2; and in which

Figure 1:
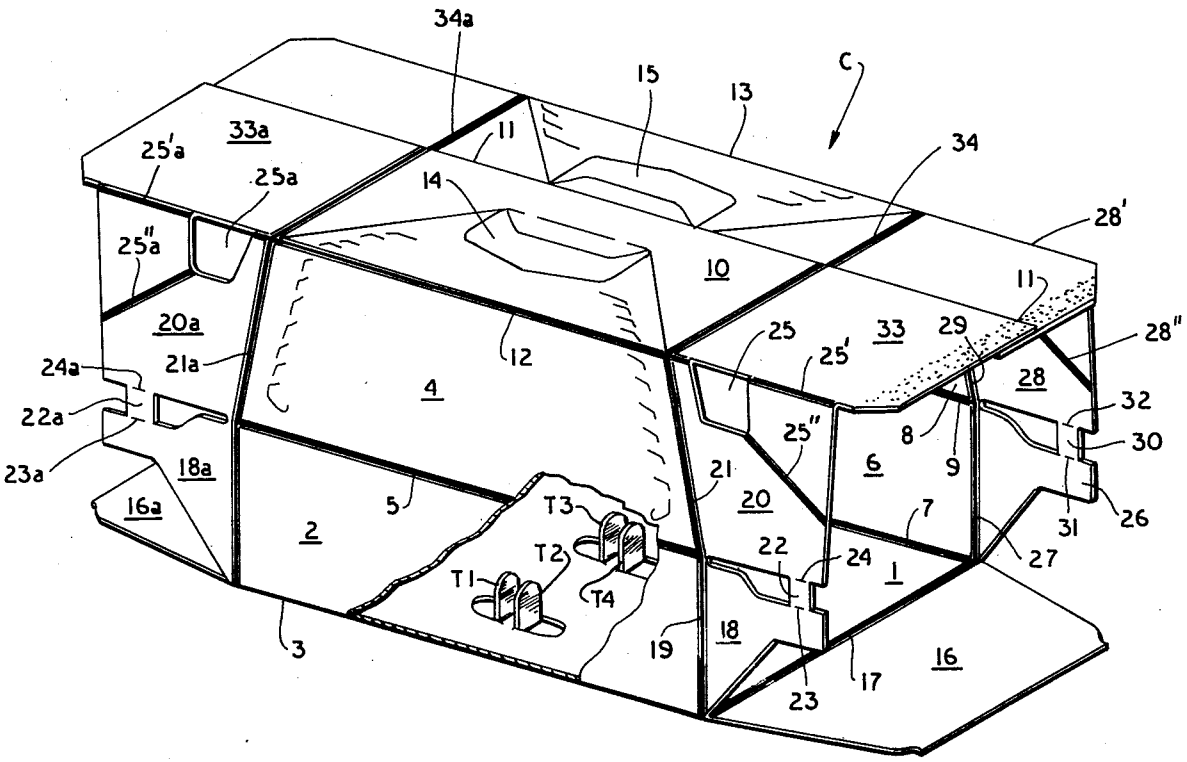

In FIG. 1 the open ended sleeve type carton shown in that figure comprises a bottom panel 1, a lower side wall panel 2 which is foldably joined to the side edge of bottom panel 1 along fold line 3 together with a sloping upper side wall panel 4 which is foldably joined to the lower side wall panel 2 along fold line 5. The other side of the carrier is similar in that a lower side wall panel 6 is foldably joined along fold line 7 to a side edge of bottom panel 1 and a sloping upper side wall portion 8 is foldably joined to lower side wall portion 6 along fold line 9. Top wall panel 10 is a composite panel and is overlapped at its mid-portion 11. Top panel 10 is foldably joined along fold line 12 to panel 4 and along fold line 13 to panel 8. A pair of hand gripping apertures 14 and 15 are formed in known manner in top panel 10.

The end flaps at the two ends of the carton are identical and the flaps at only one end will be described, the flaps at the other end having the same numerals with the subscript *a* added. For example, bottom end panel 16 is foldably joined along fold line 17 to an end edge of bottom panel 1. Lower end flap 18 is foldably joined to panel 2 along fold line 19 while upper end flap 20 is foldably joined to panel 4 along fold line 21. Web panel 22 is foldably joined to panel 18 along fold line 23 and to panel 20 along fold line 24. Panel 20 is provided with an aperture 25 for receiving a part of the cap of the adjacent article such as a bottle and includes a diagonal fold line 25″.

On the opposite side of the carton, lower end flap 26 is foldably joined to lower side wall panel 6 along fold line 27 while upper end flap 28 is foldably joined to upper side wall panel 8 along fold line 29 and includes diagonal fold line 28″. Web panel 30 is foldably joined to lower end flap 26 along fold line 31 and to upper end flap 28 along fold line 32. Upper end panel 33 is a composite panel and is foldably joined to top wall 10 along fold line 34 and to panels 20 and 28 along fold line 25′ and 28′ respectively. Tabs T1, T2, T3, T4 and two other similar tabs not shown in FIG. 1 are for the purpose of separating the bottom portions of adjacent bottles from each other.

Figure 2:
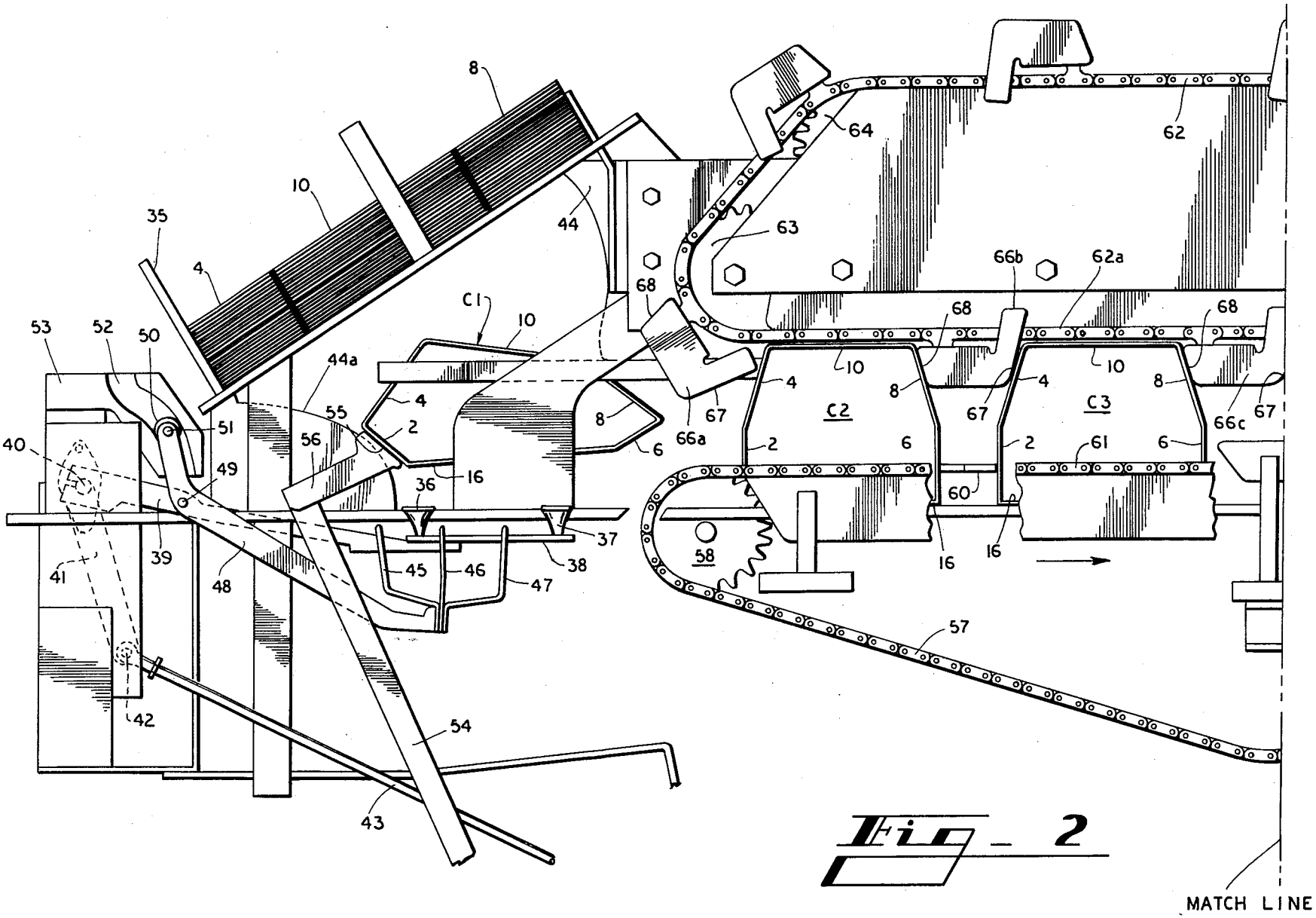
FIG. 2 is a side view of the entry end portion of a machine formed according to the invention and which is specially adapted for use in setting up and loading the container shown in FIG. 1.

A stack of container blanks such as that represented in FIG. 1 are collapsed in such manner that the top panel 10 is disposed centrally and on top while the upper portion 4 of one side wall and the upper portion 8 of the other side wall are disposed alongside top wall 10. Bottom wall 1 and the lower side wall panels 2 and 6 are disposed underneath panels 10, 4 and 8, the sleeve being folded along fold lines 5 and 9. Hopper 35 shown in FIG. 2 is of conventional construction and is disposed above means for withdrawing in sequence collapsed containers from the hopper 35 which means includes a plurality of suction cups such as are designated at 36 and 37 and which are secured to a cross arm 38 mounted on an operating arm 39 which in turn is pivoted at fixed pivot 40. A crank 41 is integrally formed with arm 39 and is pivotally connected at 42 with a reciprocable operating lever 43 driven in known manner by means not shown in the drawings. Thus reciprocation of arm 43 imparts oscillatory movement to crank 41 about pivot 40 and in turn to arm 39 so that swinging movement of arm 39 in a counterclockwise direction about fixed pivot 40 causes suction cups 36 and 37 to engage the lowermost container blank C. Reversal of this movement causes arm 39 to swing in a clockwise direction about fixed pivot 40 and results in withdrawal of the lowermost container C from hopper 35.

It is desirable to initiate a container setting up operation during withdrawal of the lowermost container C from the hopper 35. Toward this end an arcuate abutment element 44 is disposed so as to engage a collapsed carton along the fold line 9 between lower side wall panel 6 and upper side wall panel 8 and the abutment element 44*a* is disposed to engage the collapsed carton along fold line 5 between panels 2 and 4. As is apparent from FIG. 2 element 44 is disposed so as to force the panels 6 and 8 to swing about their adjoining fold line 9 and the element 44*a* forces panels 2 and 4 to swing about fold line 5 thus to initiate a setting up operation so that when the container occupies the position designated C1 the container is in partially set up condition.

In order to swing the bottle separating tabs such as are designated in the drawing in FIG. 1 at T1, T2, T3 and T4 as well as two other tabs not observable in FIG. 1 into partially set up condition, a plurality of probes designated by the numerals 45, 46, and 47 are arranged to engage one row of tabs such as T2, T4 and another similar tab which is aligned transversely with tabs T2 and T4 but which is not observable in FIG. 1. Similar probes corresponding to probes 45, 46 and 47 are disposed behind those probes and serve to engage tabs T1, T3 and another transversely aligned tab not observable in FIG. 1 to initiate setting up of those tabs. Probes 45, 46, 47 and their associated probes not shown are mounted on an operating arm 48 which is pivoted at 49 to operating arm 39 so that swinging movement of arm 39 as described imparts swinging movement to arm 48. In order to effect smooth and efficient swinging movement of arm 48, a roller 50 is mounted by pin 51 to the upper end of crank 48 and arranged so that the roller 50 rides in a cam slot 52 formed in a fixed element 53. Thus roller 50 accommodates a slight shifting of the upper end of arm 48 as that arm and its probes are swung into and out of engagement with the tabs such as T1, T2 and the like.

Once a container is withdrawn from the hopper 35 and moved to the position represented at C1, it is necessary to move the partially set up container toward the right as viewed in FIG. 2 in order to continue a setting up operation. Toward this end an oscillatable operating rod 54 is arranged to swing from left to right about a pivot not shown and is operated by means not shown so as to cause the face 55 of stud 56 to engage lower side wall panel 2 as shown in FIG. 2. Thus movement in a counterclockwise direction of the arm 54 causes the carton to move from the position indicated at C1 to that indicated at C2.

Movement of the containers from left to right from position C2 is effected by container advancing means which comprises an endless element 57 rotatable about a sprocket 58 mounted on a suitable shaft supported by the frame of the machine in known manner. Endless element 57 is also trained about sprocket 59. Sprocket 59 is a driven sprocket while sprocket 58 is an idler sprocket. It will be understood that the side views represented by FIGS. 2 and 3 do not so indicate but in fact there are two endless elements spaced transversely apart and between which a plurality of flight bars designated by the numeral 60 extend with their ends secured to the chains so that movement of the working reach 61 of the endless element 57 toward the right as viewed in FIGS. 2 and 3 causes the transversely disposed flight bars 60 to move in the direction of movement of the containers C to cause a container for example such as that disposed at C2 to move to the position represented at C3 and subsequently throughout the remaining portion of the machine.

For the purpose of shaping partially set up containers into fully set up condition as represented at position C3, an upper endless element 62 having a working reach 62*a* is provided and is trained about sprockets 63, 64 and 65, sprocket 65 being a driving element and sprocket 63 and 64 being driven elements. Thus as is apparent from FIGS. 2 and 3, the working reach 62*a* of endless element 62 moves immediately above the path of movement of the containers C as they move from left to right.

Figure 3:
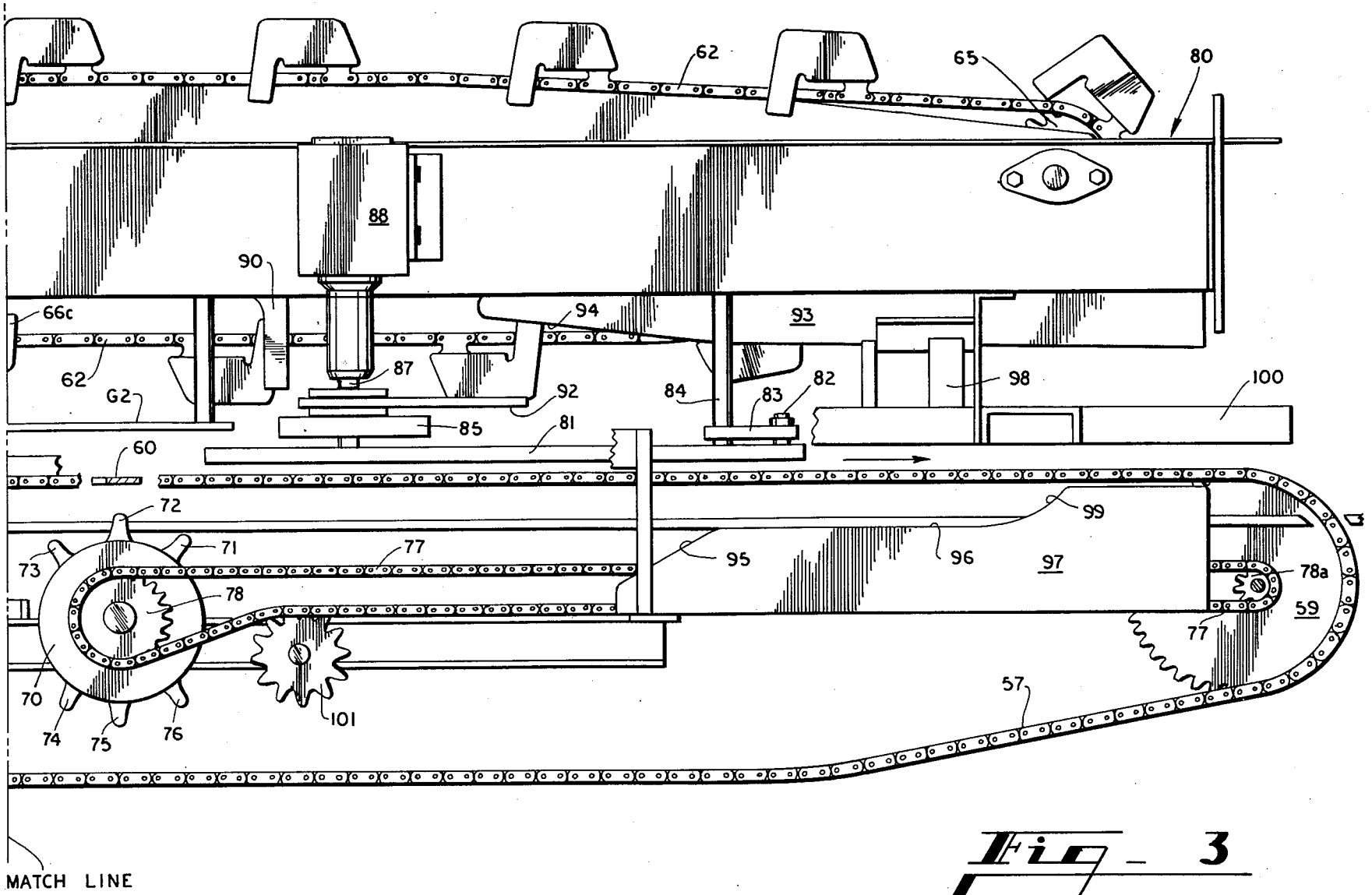

In order to engage parts of the upper portion 4 of the trailing side wall of a container such as C2, shaper blocks 66*a*, 66*b*, 66*c* and the like are provided. Each shaper block includes a leading face 67 which projects toward upper endless element 62 a distance greater than the trailing face 68 as is shown in FIGS. 2 and 3. Since the flight bars 60 engage only the lower parts of the containers, there is a tendency for the upper parts thereof to tilt rearwardly toward the left as viewed in FIG. 2 and thus to lag somewhat behind the lower parts. Thus as shown in FIG. 2, the leading face 67 engages the upper part 4 of carton C2 and swings the carton into set up condition due to the fact that each shaper block is rigidly mounted to a link of upper endless element 62 as is apparent from observation of the five shaper blocks shown in FIG. 2. As is apparent, the space between panel 8 of the leading side wall of container C2 is engaged by trailing face 68 of shaper block 66*b* while the part designated as panel 4 which constitutes a part of the trailing side wall of container C3 is engaged by leading face 67 of shaper block 66*b*. Since the containers C are intended for use in conjunction with bottles having tapered necks, it is desirable for the containers to be set up in such manner that a cross section of the containers as viewed for example in FIG. 2 takes the form of a trapezoid. Of course it is within the purview of the invention to shape the leading and trailing faces of the shaper blocks in such manner as to set up the particular carton into some configuration other than that of a trapezoid.

With the containers fully set up into open ended condition as represented for example at position C3 in FIG. 2, the containers are moved toward the right and the bottle separating tabs such as those shown in FIG. 1 at T1, T2, T3 and T4 and which were initially broken out of the plane of bottom panel 1 by probes 45, 46 and 47 are engaged by a pair of rotatable elements one of which is shown in FIG. 3 and designated by the numeral 70 on which are mounted two sets of radially extending probes 71, 72, 73, 74, 75 and 76. Thus probe 71 cooperates with a tab not shown in FIG. 1 but which is aligned with tabs T4 and T2 with which probes 72 and 73 cooperate respectively. Probes 74, 75 and 76 engage the corresponding tabs of the subsequent carton while a rotatable element similar to 70 and which is transversely spaced therefrom engages probes T1, T3 and another transversely aligned probe not shown in FIG. 1.

For the purpose of rotating the rotatable element 70 in a clockwise direction, an endless chain 77 is trained about a sprocket 78 affixed to and rotatable with rotatable element 70 and a driving sprocket 78*a* is arranged to impart operating movement thereto. A tightening sprocket 101 is adjustably mounted for determining the tension of endless element 77 and if need be for accommodating left to right adjustment of the rotatable element 70.

Figure 4:
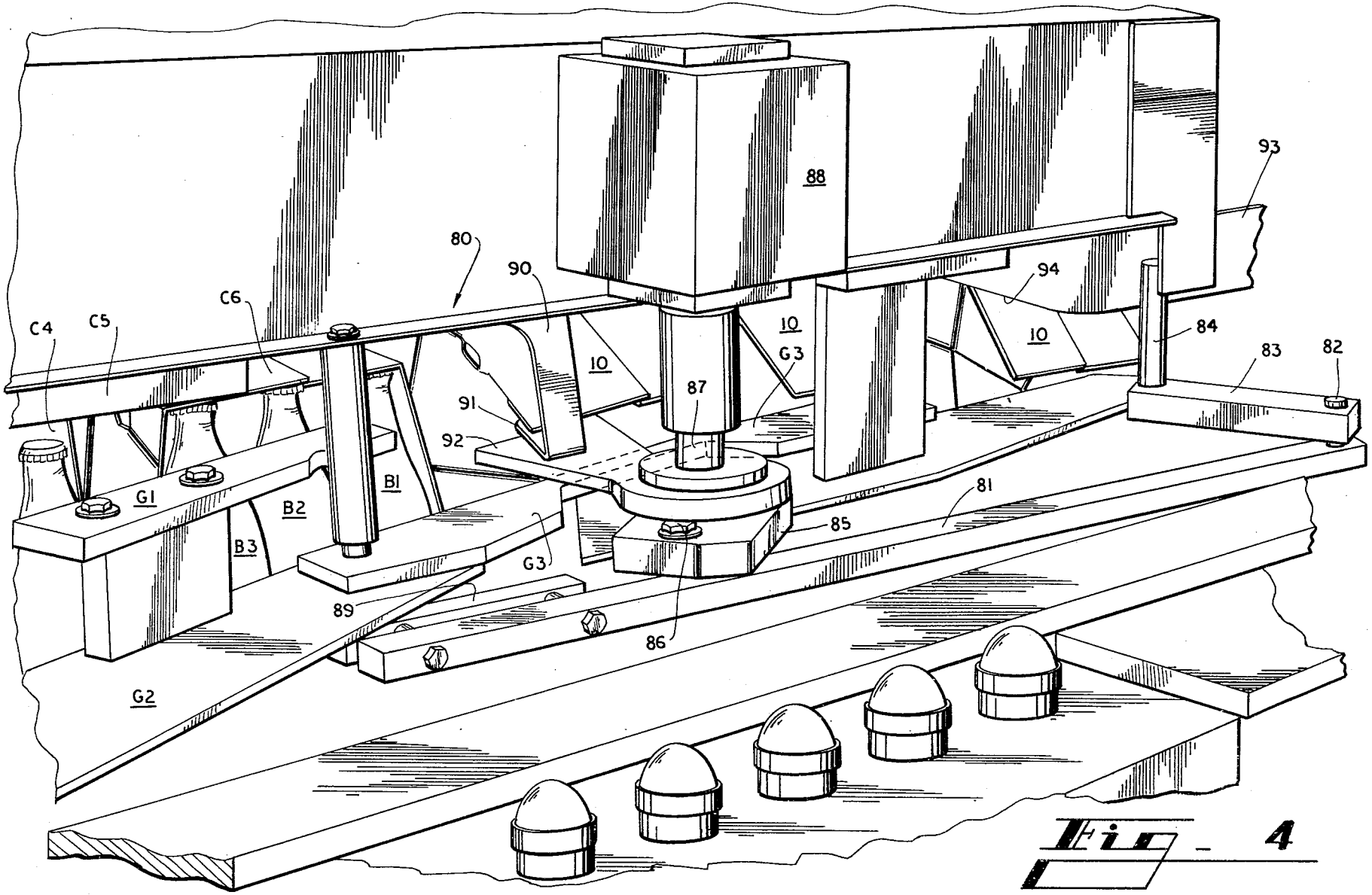
FIG. 4 is a perspective view taken from the side of the machine shown in FIGS. 2 and 3 and which shows the container loading and flap closing elements of the invention.

With the container completely set up, bottles which are disposed transversely outward on each side of the machine as shown in FIG. 4 are guided inwardly toward the loading station generally designated by the numeral 80. Bottles such as are indicated at B1, B2 and B3 in FIG. 4 are guided transversely inward by an upper guide G1 and a lower guide G2 and are controlled by guide G3 which are fixed in position and supported on the frame of the machine by any suitable means.

With an open ended container disposed at the loading position represented at C6 as best shown in FIG. 4, the bottles B1, B2 and B3 are loaded into the open end of carton C6 by an oscillatable loading arm 81 which is pivoted at 82 to one end of a pivot link 83 the other end of which is pivoted at fixed pivot 84. Oscillatory motion is imparted to loading arm 81 by rotatable element 85 which is interconnected with loading arm 81 by pin 86. Rotary motion is imparted to rotary element 85 by means of rotatable shaft 87 driven by a gear box 88 which in turn is operated by any suitable known means. In order to cushion the engagement between operating arm 81 and a group of bottles such as B1, B2 and B3, a yieldably mounted article engaging part 89 is yieldably mounted on the left hand end of loading arm 81 as is best shown in FIG. 4.

As is apparent from FIGS. 3 and 4, oscillatable loading arm 81 and particularly the article engaging part 89 thereof is characterized by a component of movement which is transverse to the direction of movement of the containers and to the groups of bottles and by another component which is in the direction of movement of those bottles so that with the containers and bottles continuously moving from left to right as viewed in FIGS. 3 and 4, the article engaging part 89 imparts transverse movement of bottles such as B1, B2 and B3 into the open end of the container located for example at the position indicated at C6. All the while a component of movement of article engaging part 89 of loading arm 81 is also in the direction of movement of the bottles and of the containers and thus does not impart undesired damaging scraping action to the bottles or to the ends of the containers. While a group of three bottles such as B1, B2 and B3 is shown at the loading station 80, it will be understood that a greater or lesser number of bottles may be loaded simultaneously at one or both ends of a container C.

After the bottles are loaded, it is then necessary to close the end flaps of the container. As is apparent in FIG. 4 a side wall end folding plow designated by the numeral 90 is provided with a horizontally extending part 91 which engages the end flaps 26, 28 and web 30 on the leading side wall 6, 8 of a container located at position C7. Thus with plow 91 disposed for engagement by end flaps 27, 28 and web 30, those flaps are folded generally toward the left as viewed in FIG. 1.

Simultaneously with the folding of side wall end flaps 27 and 28 and web 30 by the fixed plow 91, trailing side wall end flaps 18 and 20 and web 22 are folded by rotatable trailing flap folding element 92 which is rigidly affixed to shaft 87 and which rotates in a clockwise direction as viewed from above and at a speed which is greater than that at which the container C7 is moved from left to right. Thus inward folding to the right of end flaps 18 and 20 and of web 22 is effected by rotatable element 92 which engages the trailing end flaps of carton C7 subsequent to engagement of articles such as B1, B2 and B3 at station C6 by article engaging part 89 of the loading arm 81. This sequence and the proper timing therebetween is insured by the fact that the same shaft 87 imparts rotary motion to flap folder 92 and also imparts through rotatable element 85 oscillatory motion to loading arm 81.

After the side wall end flaps such as 27, 28, 18 and 20 and their webs are folded inwardly, it is then simply necessary to fold the top wall end flap 33 downwardly followed by upward folding of bottom wall end flap 16 in conjunction with the proper application of glue to the outer surface of flap 33. These folding operations are effected as best shown in FIG. 3 by fixed top wall end flap folding plow 93 having a downwardly tapering edge 94 under which end wall flap 33 is movable. Following downward folding of top wall end flap 33, bottom wall end flap 16 rides above the upwardly tapered surface 95 and the generally horizontal surface 96 of the fixed bottom wall end flap folding plow 97. During movement of the flap 16 along the horizontal portion 96 of plow 97, an application of glue is made to the lower portion of top wall end flap 33 as indicated by stippling in FIG. 1. Such application of glue is made by the glue applying means 98 which preferably constitutes a conventional nozzle. Following this application of glue, bottom wall end flap 16 rides along the upwardly extending portion 99 of plow 97 and by suitable fixed compression plows designated by the numeral 100 the upper edge of flap 16 is forced into firm and secure adhering contact with the lower glued edge of the outer surface of flap 33 and the container is then complete.

Of course it will be understood that the carton such as C is loaded from both its open ends and that mechanism similar to that shown in FIGS. 2, 3 and 4 is disposed on the opposite side of the machine and serves to load the left end of the carton as viewed in FIG. 1 and to close the end flaps associated with that end of the carton.

The embodiments of the invention in which an exclusive property or privilege is claimed are defined as follows:

1. A packaging machine for setting up, loading, and closing the end flaps of collapsed sleeve type bottle containers having top walls which are more narrow than their bottom walls and having inwardly tapered sloping upper side wall panels, said machine comprising a hopper in which collapsed containers are disposed, means for withdrawing said containers in sequence from said hopper, means for initiating setting up of the containers, container advancing means including endless elements and spaced flight bars thereon for engaging the lower part of the trailing side wall of each of the containers in sequence and for moving the containers while disposed transversely along a preselected path in a rearwardly tilted condition and alongside loading and end flap closing stations, means for loading articles through at least one end of the containers, means for closing the container end flaps, and wherein the improvement comprises an upper endless element having a working reach movable above and along said preselected path, and a plurality of shaper blocks fixedly mounted in spaced relation on said upper endless element and respectively interposed between adjacent containers, each of said shaper blocks having a leading part which extends toward said upper endless element a greater distance than the trailing part thereof and each shaper block being engageable with at least a part of the sloping upper side wall panel of a preceding container in coordination with movement onto the working reach of said upper endless element to advance the rearwardly tilted upper part thereof relative to the lower part thereof and each shaper block also being engageable with at least a part of a succeeding container and being configured so as to cause the container side walls to define in cross section parts of a trapezoidal configuration.

2. A machine for loading a group of articles through an open end of a sleeve type container having open end flaps foldably joined to adjacent end edges of the container top, bottom and side walls, said machine comprising means for advancing the container along a predetermined path with the container disposed astride and in transverse relation to said path, means for advancing a group of articles alongside said path of movement and adjacent an open end of the container, and wherein the improvement comprises an oscillatable loading arm disposed alongside said path and having an article engaging part mounting means for said loading arm arranged to move said article engaging part in a direction transverse to the path of movement of the container and of the group of articles and simultaneously movable in the direction of movement of the container and articles and engageable with the group of articles to cause the articles to move into the open ended container while the container and articles are moved continuously, said mounting means including fixed pivot means and a pivot link pivotally mounted at one end on said fixed pivot and pivotally interconnected at the other end with said loading arm at a part thereof remote from said article engaging part.

3. A machine according to claim 2 wherein a rotatable driving element is pivotally connected with said loading arm intermediate the ends thereof for imparting article loading movement thereto.

4. A machine according to claim 3 wherein a flap folding arm is secured to and rotatable in unison with said driving element.

5. A machine according to claim 4 wherein said flap folding arm engages and folds an end flap foldably joined to the adjacent end edge of the trailing side wall.

6. A machine according to claim 2 wherein a fixed side wall end flap folding plow is disposed alongside said path and arranged to engage the end flap foldably joined to an adjacent end edge of the leading side wall to impart closing movement thereto following completion of a container loading operation.

7. A machine according to claim 2 wherein a fixed top wall end flap folding plow is disposed alongside said path and arranged to engage the end flap foldably joined to the adjacent end edge of the top wall to impart downward folding closing movement thereto following initiation of closing movement of the end flaps foldably joined to said side walls.

8. A machine according to claim 2 wherein a fixed bottom wall end flap folding plow is disposed alongside said path and arranged to engage the end flap foldably joined to the adjacent end edge of the bottom wall to impart upward folding closing movement thereto following initiation of closing movement of the end flap foldably joined to said top wall.

9. A machine according to claim 8 wherein glue applying means applies glue to the outer surface of the end flap which is foldably joined to said top wall before completion of closing movement of said end flap foldably joined to said bottom wall.

* * * * *

UNITED STATES PATENT OFFICE

CERTIFICATE OF CORRECTION

PATENT NO. : 4,012,887

DATED : March 22, 1977

INVENTOR(S) : Rodney K. Calvert and Dale K. Scott

It is certified that error appears in the above-identified patent and that said Letters Patent are hereby corrected as shown below:

Column 1, line 39, cancel "paths" and substitute - ready -

Signed and Sealed this

Seventh Day of June 1977

[SEAL]

*Attest:*

RUTH C. MASON
*Attesting Officer*

C. MARSHALL DANN
*Commissioner of Patents and Trademarks*